US006244350B1

(12) United States Patent
Gudmestad et al.

(10) Patent No.: US 6,244,350 B1
(45) Date of Patent: Jun. 12, 2001

(54) APPARATUS FOR LAUNCHING AT LEAST ONE PLUG INTO A TUBULAR IN A WELLBORE

(75) Inventors: Tarald Gudmestad; Jone Salte, both of Naerbo (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/319,485

(22) PCT Filed: Dec. 8, 1997

(86) PCT No.: PCT/GB97/03282

§ 371 Date: Jul. 20, 1999

§ 102(e) Date: Jul. 20, 1999

(87) PCT Pub. No.: WO98/25004

PCT Pub. Date: Jun. 11, 1998

(30) Foreign Application Priority Data

Dec. 6, 1996 (NO) ..... 965212

(51) Int. Cl.[7] ..... E21B 33/12; E21B 33/13

(52) U.S. Cl. ..... 166/386; 166/332.1

(58) Field of Search ..... 166/153, 154, 166/156, 285, 332.1, 373, 381, 386

(56) References Cited

U.S. PATENT DOCUMENTS

| | | | |
|---|---|---|---|
| 2,620,037 | 12/1952 | McClendon | 166/70 |
| 3,102,595 | 9/1963 | Fisher, Jr. et al. | 166/156 |
| 3,507,325 | 4/1970 | Scott | 166/335 |
| 3,545,542 | 12/1970 | Scott | 166/155 |
| 3,616,850 | 11/1971 | Scott | 166/155 |
| 3,635,288 | 1/1972 | Lebourg | 166/156 |
| 3,730,267 | 5/1973 | Scott | 166/335 |
| 3,796,260 | 3/1974 | Bradley | 166/153 |
| 3,863,716 | 2/1975 | Streich | 166/70 |
| 3,951,208 | 4/1976 | Delano | 166/78.1 |
| 3,971,436 | 7/1976 | Lee | 166/70 |
| 4,047,566 | 9/1977 | Duke | 166/285 |
| 4,164,980 | 8/1979 | Duke | 166/291 |
| 4,290,482 | 9/1981 | Brisco | 166/70 |
| 4,317,486 | 3/1982 | Harris | 166/250.04 |
| 4,427,065 | 1/1984 | Watson | 166/250.04 |
| 4,433,859 | 2/1984 | Driver et al. | 285/34 |
| 4,479,545 * | 10/1984 | Eley | 166/318 |
| 4,624,312 | 11/1986 | McMullin | 166/155 |
| 4,809,776 | 3/1989 | Bradley | 166/153 |
| 4,917,184 | 4/1990 | Freeman et al. | 166/285 |
| 5,024,273 | 6/1991 | Coone et al. | 166/289 |

(List continued on next page.)

FOREIGN PATENT DOCUMENTS

| | | | |
|---|---|---|---|
| 0 500165AL | 8/1992 | (EP) | E21B/33/05 |
| 0 450676B1 | 6/1995 | (EP) | E21B/33/05 |
| 1 232 145 | 5/1971 | (GB) . | |
| WO 94/15063 | 7/1994 | (WO) | E21B/33/16 |
| WO 94/27026 | 11/1994 | (WO) | E21B/33/16 |
| WO 97/21019 * | 6/1997 | (WO) | E21B/33/16 |

OTHER PUBLICATIONS

Subsea Cementing Equipment, BJ Services, pp. 9, 10; p. 10 of 13, 1994.

Primary Cementing, Stage And Stab–In Cementing Equipment And Services, Bakerline, Baker, 1982, pp. 14–16.

*Primary Examiner*—David Bagnell
*Assistant Examiner*—Jennifer M Hawkins
(74) *Attorney, Agent, or Firm*—Guy McClung

(57) ABSTRACT

An apparatus for launching at least one plug into a tubular in a wellbore, in certain aspects, the apparatus having a hollow upper section with at least first and second upper ports one above the other, a landing seat, and a first fluid displaceable member below the second upper port, the hollow lower section adapted to retain a plug and having a first lower port and a landing collar for the fluid displaceable member.

17 Claims, 7 Drawing Sheets

U.S. PATENT DOCUMENTS

| | | | |
|---|---|---|---|
| 5,095,988 | 3/1992 | Bode | 166/291 |
| 5,165,474 | 11/1992 | Buisine | 166/156 |
| 5,246,069 | 9/1993 | Glaser et al. | 166/156 |
| 5,392,852 | 2/1995 | Laurel et al. | 166/153 |
| 5,443,122 | 8/1995 | Brisco | 166/285 |
| 5,813,457 | 9/1998 | Giroux et al. | 166/153 |
| 5,829,526 | 11/1998 | Rogers et al. | 166/291 |
| 5,856,790 | 1/1999 | Baugh et al. | 340/854.6 |

* cited by examiner

APPARATUS FOR LAUNCHING AT LEAST ONE PLUG INTO A TUBULAR IN A WELLBORE

This invention relates to an apparatus for launching at least one plug into a tubular in a wellbore, for example, a liner in an oil or gas well. Wiper plugs are generally, but not exclusively used in connection with the cementing of such liners.

In the cementing of casing and liners in a wellbore, the annular space between the casing/lining and the wellbore is filled with a predetermined quantity of a cement mixture which, after hardening, retains the casing/liner in place in the wellbore.

The cement mixture is pumped in at the top end of the casing or liner, down to the lower end thereof and out into and up the annular space on the outside of the casing/liner.

Before the cement mixture is pumped into the casing/liner, it is usual, although not essential, for a first plug to be introduced at the top of the casing/liner which slides in a sealing-tight relationship against the casing/liner. When a predetermined quantity of cement mixture has been introduced into the casing/liner, a second plug is introduced in order to separate the cement mixture from a well liquid which is thereafter supplied under pressure to drive the cement mixture into the casing/liner. The first plug is adapted to be opened for cement mixture to flow therethrough when the plug lands at the lower end of the casing/liner. The cement mixture thereafter flows through the first plug, comes into contact with and displaces liquid which is in the annular space, and pressure from the liquid supplied from the surface acts behind the second plug and pushes thereon until it lands on the first plug.

Sometimes it is disadvantageous to have direct contact between the cement mixture and the liquid in the well and the annular space, since undesirable chemical reactions may take place. In that case a suitable liquid is pumped ahead of the cement mixture. This is done by introducing into the casing/liner a first plug, a separating liquid, a second plug, cement mixture, and finally a third plug. Therefore, the cement mixture substantially only comes into contact only with the separating liquid. It may also be advantageous to pump a number of special liquids through the liner/casing, both before and after the cement mixture, thereby necessitating a number of further plugs.

Generally, in the cementing of liners use is made of plugs having a central opening, so that the liquid can flow therethrough which are placed at the top of the liner. When the plug is to be launched, a sealing element such as a dart is introduced into the stream of liquid from the surface. The sealing element arrives on the plug and seals said central opening, and the water pressure then drives the sealed plug down the liner.

The above described design has been known to fail in use by either launching at least two plugs simultaneously, or by failing to launch any plugs.

According to the present invention, there is provided an apparatus for launching at least one plug into a tubular in a wellbore, said apparatus comprising a hollow upper section and a hollow lower section said hollow upper section comprising at least first and second upper ports longitudinally spaced therein, said second upper port being disposed above said first upper port, a landing seat between said hollow upper section and said hollow lower section, and a fluid displaceable member retained below said second upper port, said hollow lower section adapted to retain at least one plug and comprising at least a first lower port thereabove and a landing collar for said fluid displaceable member, the arrangement being such that in use, when the apparatus is installed at the top of a liner and lowered into a wellbore, and a dart lands on said landing seat blocking said first upper port allowing a fluid pressure differential to be created about said fluid displaceable member through said second upper port which displaces said fluid displaceable member to said landing collar, allowing a fluid pressure differential about said plug through said first lower port to launch said plug.

Preferably, said apparatus further comprises a third upper port in said hollow upper section above said second upper port and a second fluid displaceable member retained below said third port said hollow lower section adapted to retain a second plug, and comprising a second lower port thereabove, so that in use, a second dart lands on said first dart blocking said second upper port it allows a fluid pressure differential to be created about said second fluid displaceable member through said second upper port which displaces said second fluid displaceable member to said first fluid displaceable member blocking said first lower port, allowing a fluid pressure differential about said second plug through said second lower port to launch said second plug.

Advantageously, said fluid displaceable member is a sleeve which, in use, substantially blocks the annulus between the apparatus and the tubular.

When the sleeves come into the lower position, they produce the required effect by closing the liquid supply to the underside of the plug which is to be discharged from the apparatus into the liner. The pressure on the top side of the plug then displaces the plug downwards in the apparatus. The first sleeve closes the outlet of the annular space at the bottom, the second sleeve closing ports which conduct liquid from the annular space to the underside of the second plug. A third sleeve will close ports which conduct liquid from the annular space to the underside of a third plug, and so on.

Preferably, said fluid displaceable member is shear pinned to said apparatus.

Advantageously, said landing seat blocks a central fluid path between said hollow upper sections and said hollow lower sections.

Preferably, each port is the form of a horizontal row of ports.

Advantageously, said hollow upper section and said hollow lower section are of circular cross-section having equal outer diameters.

Preferably, the fluid displaceable member comprises a seal.

There is also provided a method for launching at least one plug using the apparatus defined hereabove.

For a better understanding of the present invention, reference will now be made, by way of example, to the accompanying drawings, in which:

FIG. 1 shows a liner 1 in which an apparatus 2 according to the invention is disposed.

Figure 1:
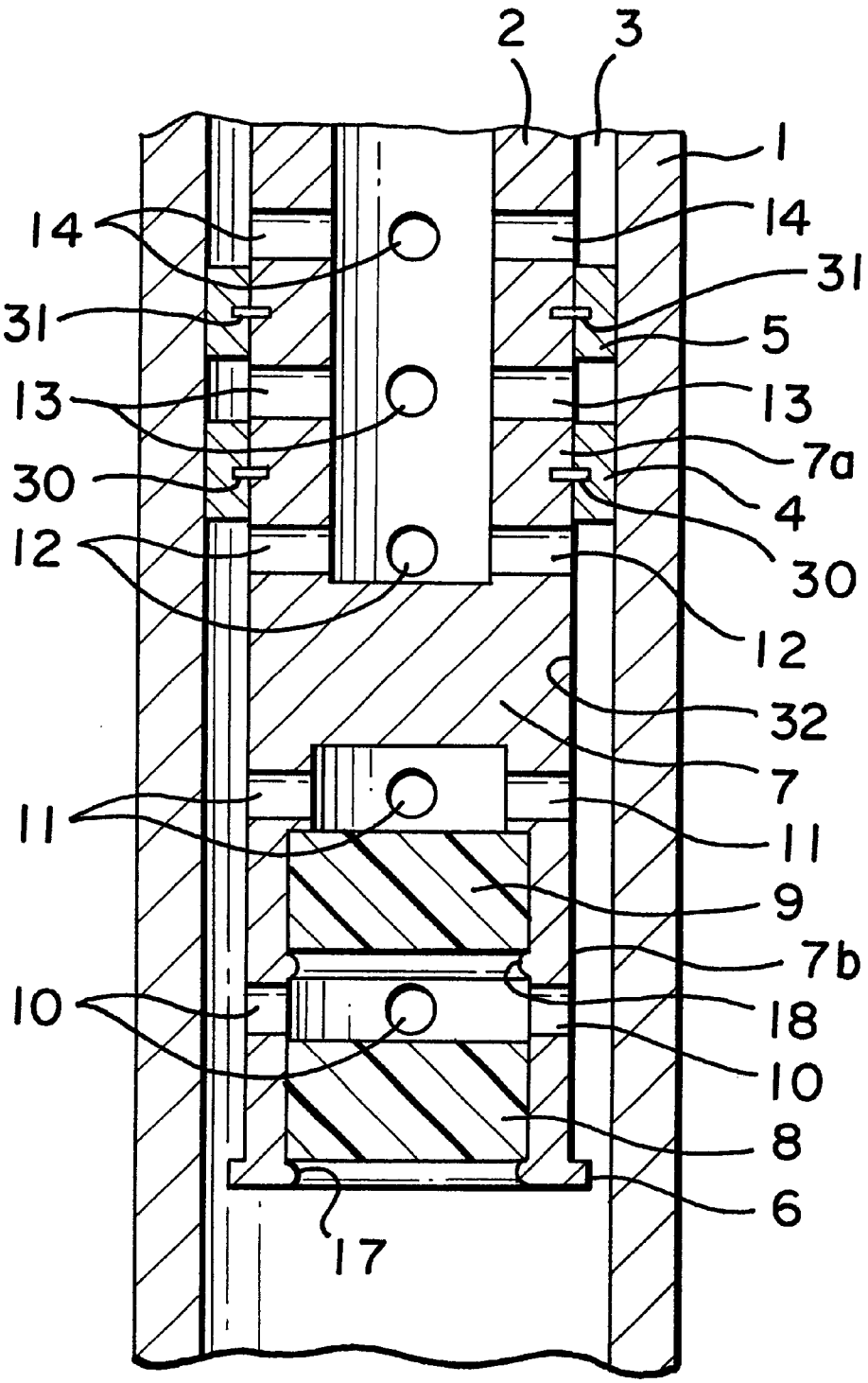
FIG. 1 is a diagrammatic cross-sectional view of part of an apparatus according to the invention, including two plugs therein, in a starting position.

The external diameter of the apparatus 2 is smaller than the internal diameter of the liner 1, or may be of equal diameter to the liner 2 and disposed in a connecting hub which is of larger diameter than the apparatus 2, so that an annular space 3 is formed between the liner 1 and the apparatus 2.

A first and second sleeve 4, 5 are arranged to slide in sealing-tight relationship against the apparatus 2 and the liner 1. The bottom of the apparatus 2 has an external annular flange 6 which prevents the sleeves 4, 5 from being separated from the apparatus 2. The annular flange 6 extends only a relatively small distance radially, so that liquid can pass between the annular flange 6 and the liner 1.

The apparatus 2 is divided by a partition 7 into 9 hollow upper section 7*a* and a hollow lower section 7*b* the partition 7 blocks a central fluid path 32 between the hollow sections 7*a*, 7*b*. A first plug 8 is arranged in the lower hollow portion of the apparatus 2, and a second plug 9 is disposed thereabove. The plugs 8 and 9 generally comprise fins which are adapted to expand from the internal diameter of the apparatus 2 to the internal diameter of the liner 1 and to slide in sealing-tight relationship against the internal surface of the liner 1. If the apparatus is arranged in a hub as described above, the plugs 8, 9 do not have to be compressed in order to expand to a working diameter.

The apparatus 2 has five sets of opening or ports which provide a fluid flow path between the apparatus 2 and the annular space 3; two sets of ports are disposed in the lower portion of the apparatus 2, below the partition 7. A first set of ports 10 is arranged above the first plug 8 and below the second plug 9. Another set of ports 11 is placed above the second plug 9.

A third set of ports 12 is placed directly above the partition 7. A fourth set of ports 13 discharges above the first sleeve 4 and below the second sleeve 5, while a fifth set of ports 14 discharges above the second sleeve 5.

The sleeves 4, 5 are retained in the starting position shown in FIG. 1 by shear pins 30, 31 respectively. Below the first and second plugs 8, 9 the apparatus 2 has internally rounded annular flanges 17 and 18 respectively of small radial extension. The annular flanges 17, 18 prevent the plugs 8, 9 from dropping out of the apparatus 2. The plugs 8, 9 can nevertheless pass the annular flanges 17, 18 when sufficient force is applied thereto. The rounded annular flanges 17 may be of a greater size than that depicted in the figures.

The liner 1 is lowered into the well by means of a setting tool (not shown) which is coupled and pressure sealed in a known manner to the top end of the liner 1 and depends from a tool string (not shown); the tool string is adapted to supply drilling liquid, cement mixture and other fluids to the top end of the apparatus 2.

While the liner 1 is being lowered into the well to be suspended in a casing by a suspension system (not shown), a liquid, typically a drilling liquid, is continuously supplied to the apparatus 2. The liquid flows out of the third set of ports 12 into the annular space 3 and down along the outside of the apparatus 2 and onwards down into the liner 1.

Figure 2:
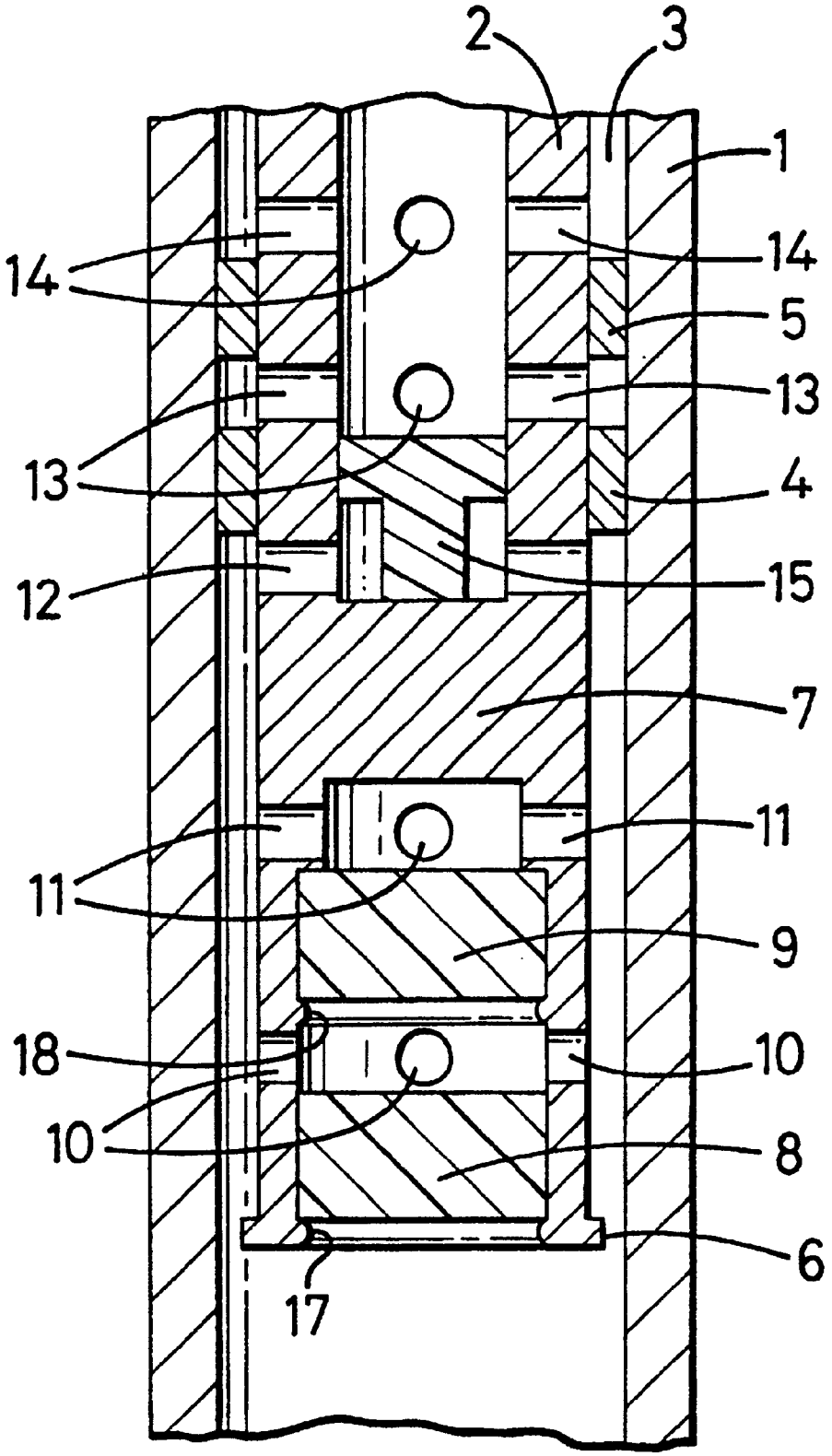
FIG. 2 shows the apparatus of FIG. 1 after a first dart has landed in the apparatus.
Figure 3:
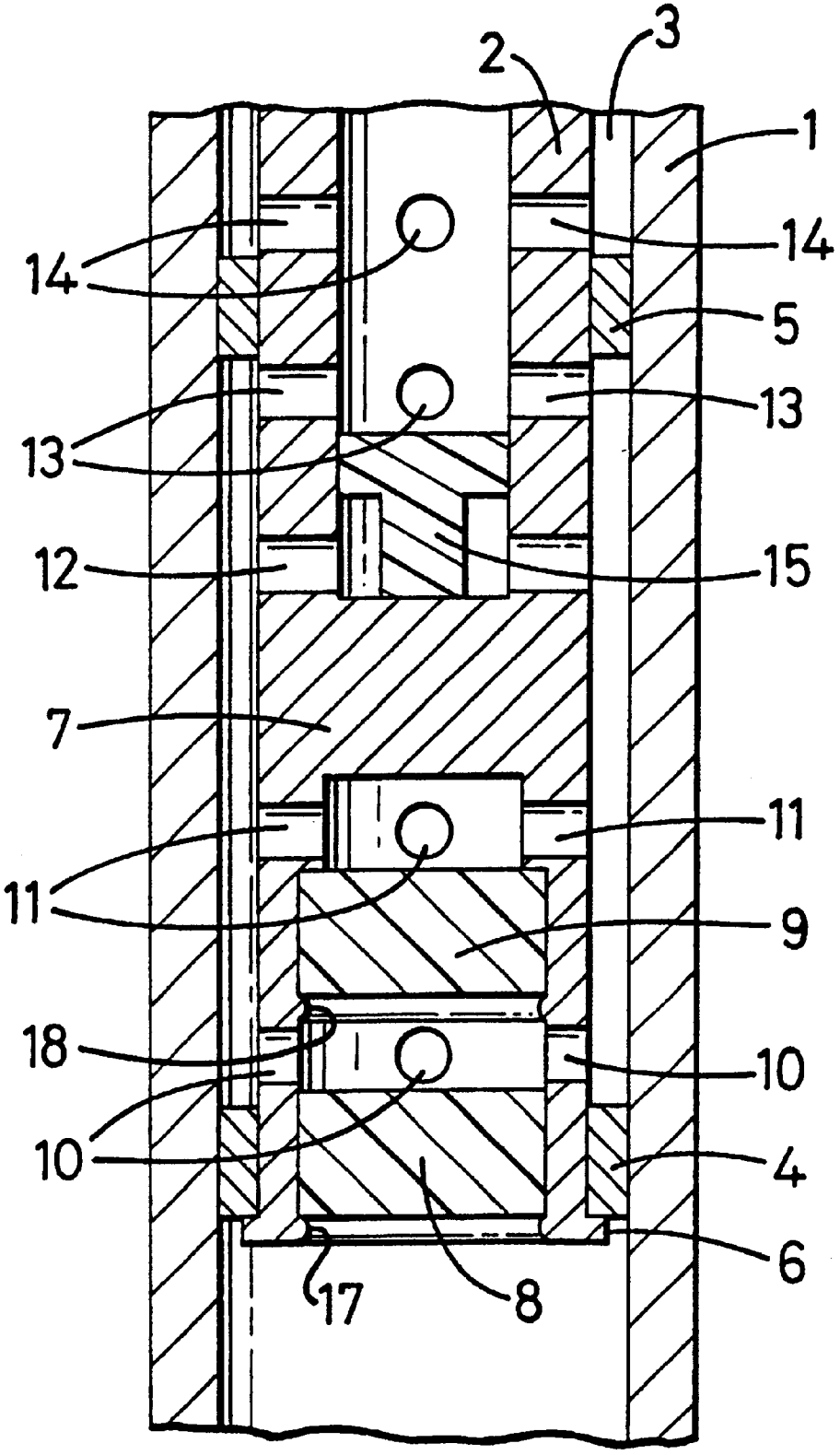
FIG. 3 shows the apparatus of FIG. 1 after a first sleeve has been displaced to a lower end of the apparatus.
Figure 4:
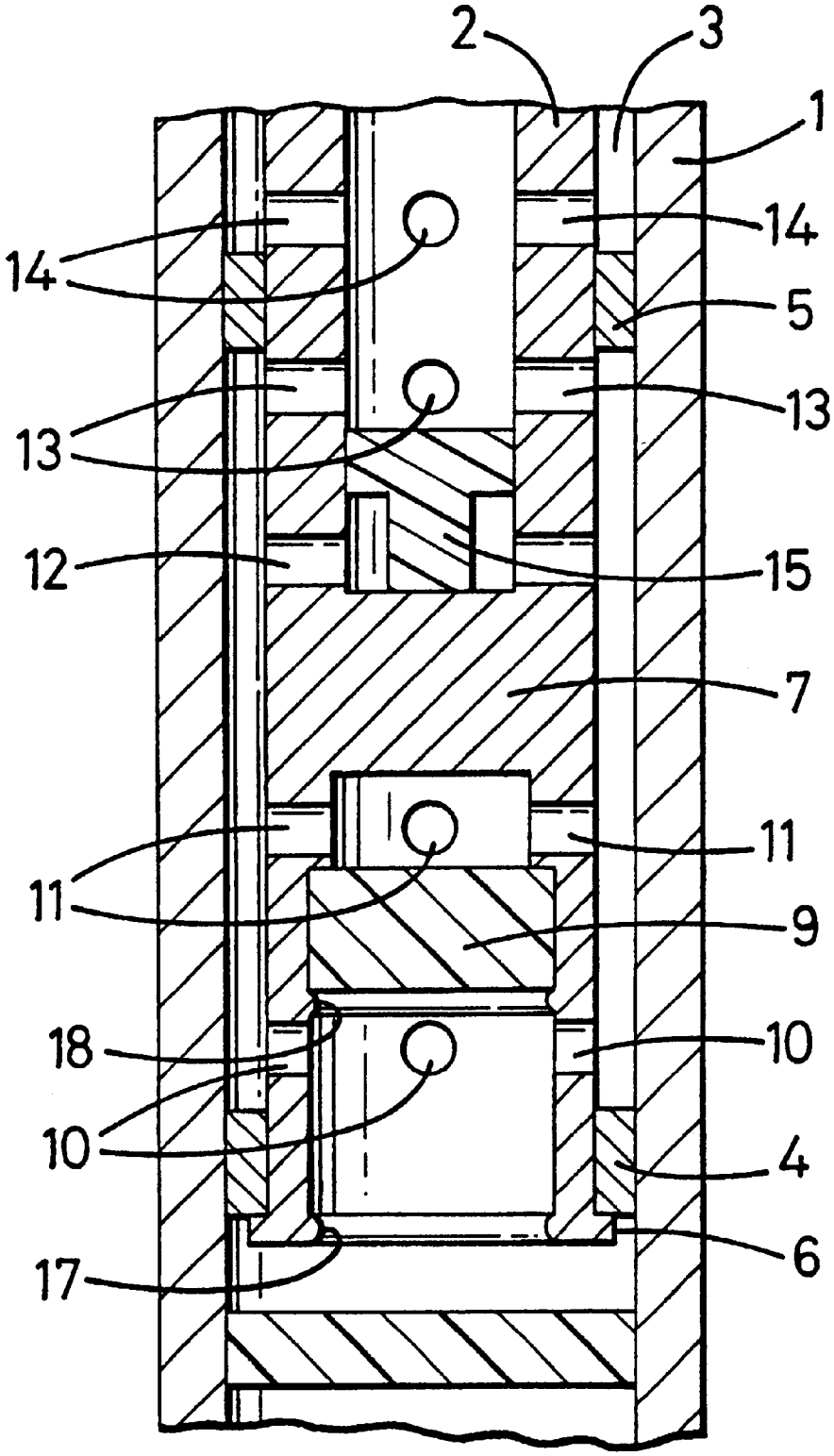
FIG. 4 shows the apparatus after a lower plug has launched from the apparatus.

When it is desired to release the first plug 8, a first dart 15 is introduced in to the tool string and pumped into the apparatus 2 where it lands on the partition 7, blocking the third set of ports 12 (FIG. 2). Liquid cannot flow out into the annular space 3, since only the sets of ports 13 and 14 are open in the upper portion of the apparatus 2. The operator then may have to increase the liquid pressure being pumped down the tool string. The pressure above and below the second sleeve 5 will therefore be in equilibrium, while the pressure above the first sleeve 4 is greater than the pressure therebelow and therefore the first sleeve 4 experiences an overall downward force so that the shear pins for retaining the first sleeve 4 are broken. Then the first sleeve 4 is driven downwardly in the annular space 3 by hydraulic pressure until the first sleeve 4 stops against the external annular flange 6 at the bottom of the apparatus 2 (FIG. 3). Liquid in the annular space 3 is then unable to flow past the lower end of the apparatus 2, but is forced inwardly over the first plug 8 via the first set of ports 10. The liquid pressure above and below the second plug 9 remains in equilibrium. The liquid pressure exerts an overall downwardly directed force on and launches the first plug 8, out into the liner 1, whereupon the fins of the first plug 8 expand and enter into sealing-tight relationship with the liner 1 (FIG. 4). Liquid supplied from the surface into the top of the apparatus 2 flows out into the annular space 3 via the fourth set of ports 13 below the second sleeve 5, down in the annular space 3, into the lower portion of the apparatus 2 via the first set of ports 10, through the lower end of the apparatus 2 and into the liner 1. The liquid therefore drives the first plug 8 down the liner 1.

Figure 5:
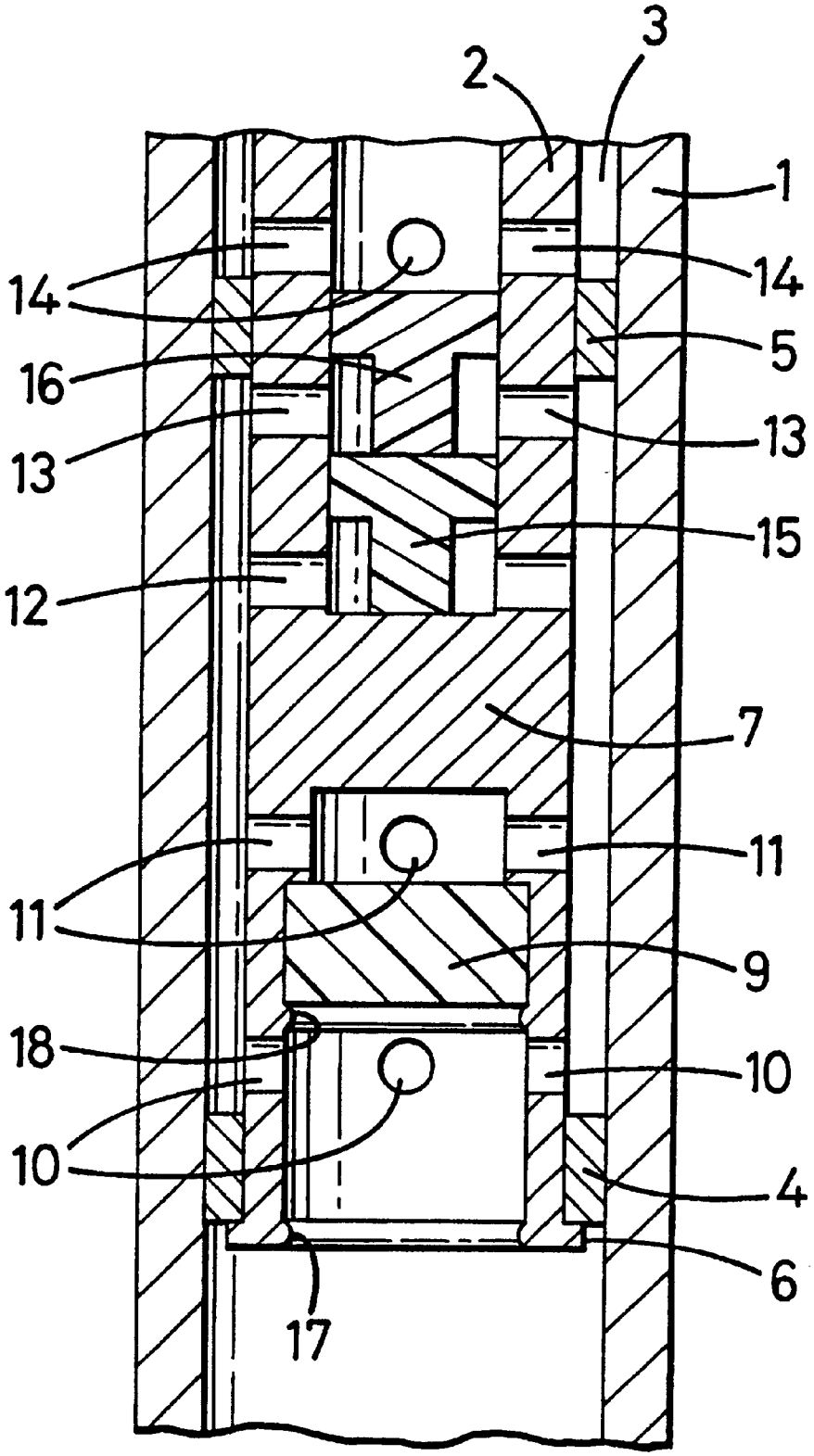
FIG. 5 shows the apparatus after a second dart has landed therein.
Figure 6:
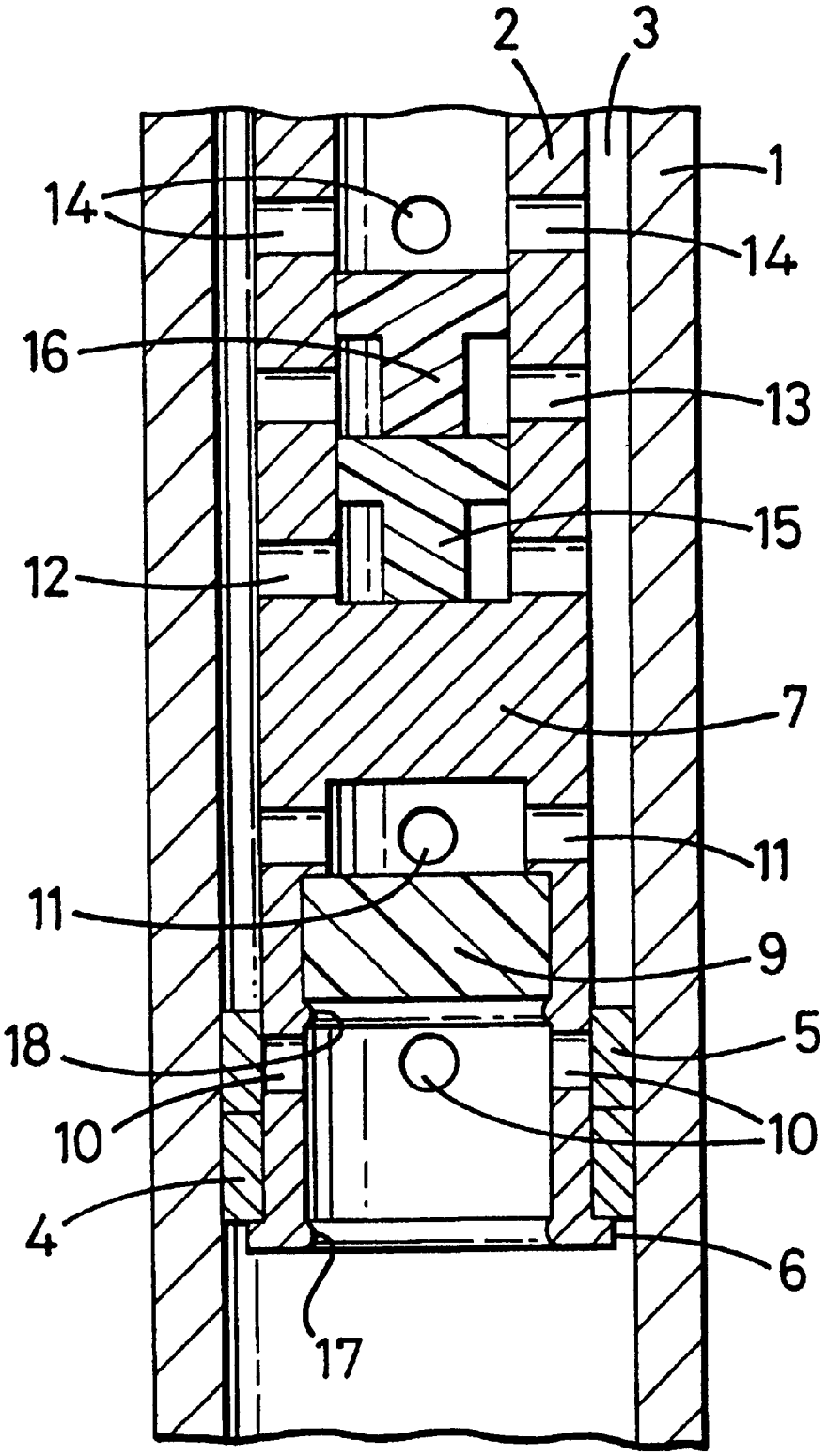
FIG. 6 shows the apparatus after a second sleeve has been displaced to the lower end thereof.
Figure 7:
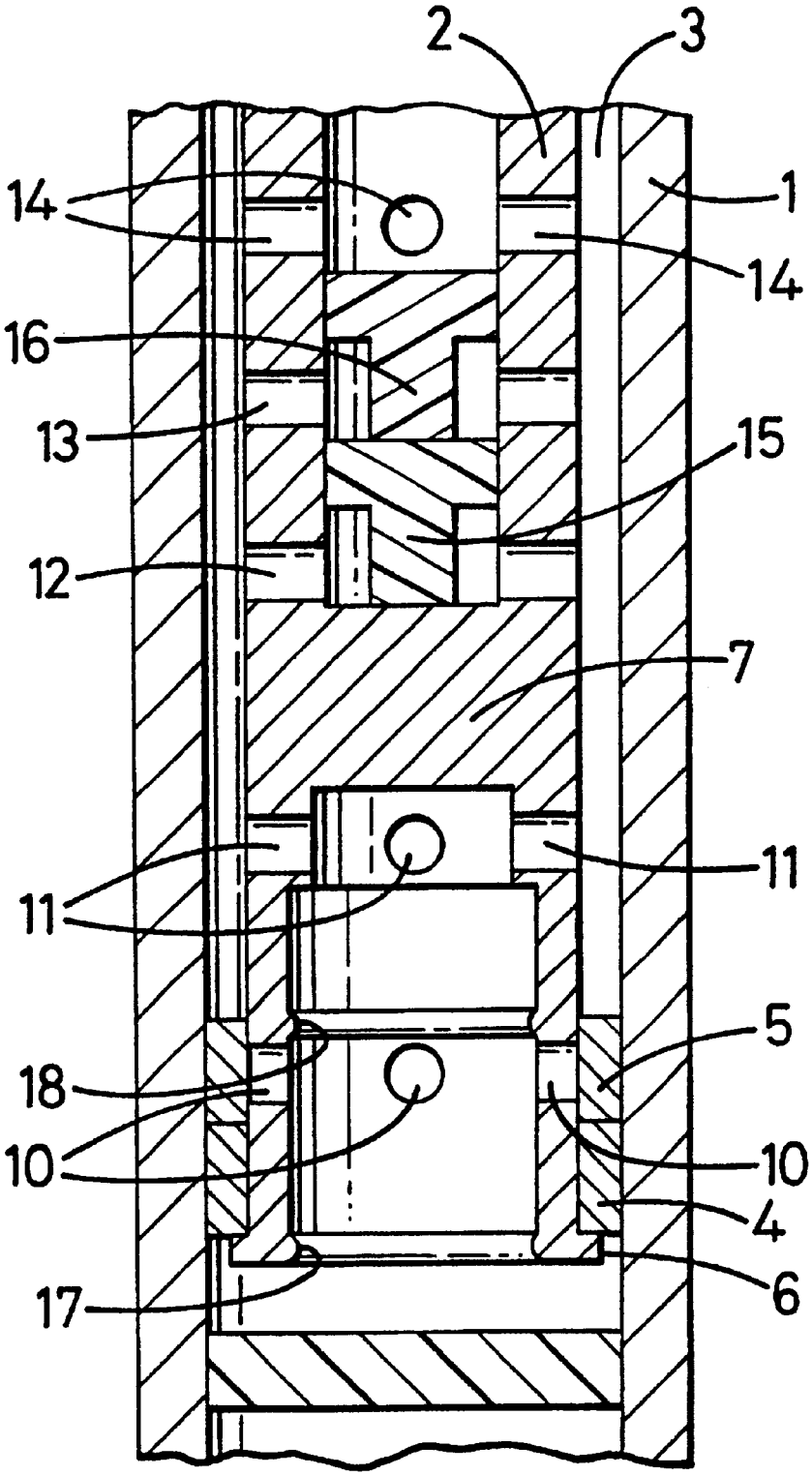
FIG. 7 shows the apparatus after a second plug has launched from the apparatus.

Subsequently, when it is desirable to introduce the second plug 9 into the liner 1, a second dart 16 is introduced into the stream of liquid on the surface, and when the dart 16 lands on the dart 15, the dart 16 blocks the fourth set of ports 13 (FIG. 5). The operator increases the liquid pressure being pumped down the tool string. The liquid pressure above the second sleeve 5 is now greater than the pressure therebelow and therefore experiences an overall downward force so that the shear pins retaining the sleeve 5 break. The second sleeve 5 is displaced downwardly in the annular chamber 3 and lands on the first sleeve 4. The second sleeve 5 then blocks the first set of ports 10 in the lower portion of the apparatus 2, so that the hydraulic pressure will act only on the top side of the second plug 9 (see FIG. 6). The hydraulic pressure will push the second plug 9 down in the apparatus 2 and out of the hollow lower portion thereof, so that the second plug 9 enters the liner 1 and expands into sealing-tight relationship with the liner 1. Liquid is then supplied from the surface to the top of the apparatus 2, out into the annular space 3 via the fifth set of ports 14, into the lower portion of the apparatus 2 via the second set of ports 11, through the lower end of the apparatus 2 and into the liner 1 (see FIG. 7). Liquid which continues to be supplied drives the second plug 9 and therefore also the preceding liquid and the plug 8 down in the liner 1.

Another modification is envisaged in that a depression may be disposed in the partition 7.

Various other modifications to the above described embodiment are envisaged, such as providing the apparatus with an additional set of ports above the port 14 and a third retained sleeve and providing the lower portion of the apparatus with means to retain a third plug and a further port thereabove, so that in use a third dart could be used to launch a third plug in a similar way to that described above. The apparatus could also be adapted in this way to launch four or more plugs.

The apparatus could be used to launch plugs or a combination of plugs and other types of plugs, such as those designed to remove cement that has set on the inside of liners known as scraper plugs.

Whilst it is desirable that the sleeves 4 and 5 should seal against the liner 1 and the apparatus 2 it will be appreciated that the apparatus 2 would still work tolerably if there is a small leak.

What is claimed is:

1. An apparatus for launching at least one plug into a tubular in a wellbore, said apparatus comprising a hollow upper section and a hollow lower section, said hollow upper section comprising at least first and second upper ports (12, 13) longitudinally spaced therein, said second upper port (13) being disposed above said first upper port (12), a landing seat (7) between said hollow upper section and said hollow lower section, and a first fluid displaceable member (4) retained below said second upper port (13), said hollow lower section adapted to retain at least one plug (8) and comprising at least a first lower port (10) thereabove and a landing collar (6) for said fluid displaceable member (4), the arrangement being such that in use, when the apparatus is installed at the top of a liner and lowered into the wellbore, and a first dart lands on said landing seat (7) blocking said first upper port (12), creating a fluid pressure differential around said first fluid displacement member (4) and through said second upper port (13), the fluid pressure differential being used to displace said first fluid displacement member (4) to said landing collar (6), allowing the fluid pressure differential about said plug through said first lower port (10) to launch said plug, said apparatus further comprising a third upper port (14) in said hollow upper section above said second upper port (13) and a second fluid displaceable member (5) retained below said third port (14) said hollow lower section adapted to retain a second plug (9), and comprising a second lower port (11) thereabove, so that in use, when a second dart (16) lands on said first dart (15) blocking said second upper port it allows a fluid pressure differential to be created about said second fluid displaceable member (5) through said second upper port which displaces said second fluid displaceable member (5) to said first fluid displaceable member blocking said first lower port (10), allowing the fluid pressure differential about said second plug (9) through said second lower port to launch said second plug.

2. An apparatus as claimed in claim 1 wherein said fluid displaceable members (4, 5) each is a sleeve which, in use, substantially blocks the annulus between the apparatus (2) and the tubular (1).

3. An apparatus as claimed in claim 1 wherein said fluid displaceable members (4, 5) are shear pinned to said apparatus.

4. An apparatus as claimed in claim 1 wherein said landing seat (7) blocks a central fluid path between said hollow upper section and said hollow lower section.

5. An apparatus as claimed in claim 1 wherein each port is the form of a horizontal row of ports.

6. An apparatus as claimed in claim 1 wherein said hollow upper section and said hollow lower section are of circular cross-section having equal outer diameters.

7. An apparatus as claimed in claim 1 wherein the fluid displaceable members each comprises a seal.

8. A method for launching at least one plug, the method comprising launching at least one plug into a tubular into a wellbore using an apparatus for launching at least one plug into a tubular in a wellbore, said apparatus comprising a hollow upper section and a hollow lower section, said hollow upper section comprising at least first and second upper ports (12, 13) longitudinally spaced therein, said second upper port (13) being disposed above said first upper port (12), a landing seat (7) between said hollow upper section and said hollow lower section, and a first fluid displaceable member (4) retained below said second upper port (13), said hollow lower section adapted to retain the at least one plug (8) and comprising at least a first lower port (10) thereabove and a landing collar (6) for said fluid displaceable member (4), the arrangement being such that in use, when the apparatus is installed at the top of a liner and lowered into the wellbore, and a first dart lands on said landing seat (7) blocking said first upper port (12), creating a fluid pressure differential around said first fluid displacement member (4) and through said second upper port (13), the fluid pressure differential being used to displace said first fluid displacement member (4) to said landing collar (6), allowing the fluid pressure differential about said plug through said first lower port (10) to launch said plug, said apparatus further comprising a third upper port (14) in said hollow upper section above said second upper port (13) and a second fluid displaceable member (5) retained below said third port (14) said hollow lower section adapted to retain a second plug (9), and comprising a second lower port (11) thereabove, so that in use, when a second dart (16) lands on said first dart (15) blocking said second upper port it allows a fluid pressure differential to be created about said second fluid displaceable member (5) through said second upper port which displaces said second fluid displaceable member (5) to said first fluid displaceable member blocking said first lower port (10), allowing the fluid pressure differential about said second plug (9) through said second lower port to launch said second plug.

9. An apparatus for launching at least one plug into a tubular in a wellbore, said apparatus comprising a hollow upper section and a hollow lower section, said hollow upper section comprising first and second upper ports (12, 13) longitudinally spaced therein, said second upper port (13) being disposed above said first upper port (12) in operation, a landing seat (7) between said hollow upper section and said hollow lower section, and a first fluid displaceable member (4) initially retained in a first position below said second upper port (13), said hollow lower section being adapted to retain the at least one plug (8) and comprising at least a first lower port (10) thereabove and a landing collar (6) for receiving said first fluid displaceable member (4) in a second position, the arrangement being such that, in use, when the apparatus is installed at the top of a liner and lowered into the wellbore, launching of said at least one plug is effected by causing a first dart to land on said landing seat (7) so as to block said first upper port (12) and create a first fluid pressure differential across said first fluid displaceable member (4) by way of said second upper port (13), the fluid pressure differential serving to displace said first fluid displaceable member (4) to the second position on said landing collar (6), thus creating a fluid pressure differential across said at least one plug by way of said first lower port (10) to launch said at least one plug.

10. An apparatus as claimed in claim 9 further comprising a third upper port (14) in said hollow upper section above said second upper port (13) and a second fluid displaceable member (5) retained below said third port (14) said hollow lower section adapted to retain a second plug (9), and comprising a second lower port (11) thereabove, so that in use, when a second dart (16) lands on said first dart (15) blocking said second upper port it allows a fluid pressure differential to be created about said second fluid displaceable member (5) through said second upper port which displaces said second fluid displaceable member (5) to said first fluid displaceable member blocking said first lower port (10), allowing the fluid pressure differential about said second plug (9) through said second lower port to launch said second plug.

11. An apparatus as claimed in claim 9 wherein said fluid displaceable members (4, 5) each is a sleeve which, in use, substantially blocks the annulus between the apparatus (2) and the tubular (1).

12. An apparatus as claimed in claim 9 wherein said fluid displaceable members (4, 5) are shear pinned to said apparatus.

13. An apparatus as claimed in claim 9 wherein said landing seat (7) blocks a central fluid path between said hollow upper section and said hollow lower section.

14. An apparatus as claimed in claim 9 wherein each port is the form of a horizontal row of ports.

15. An apparatus as claimed in claim 9 wherein said hollow upper section and said hollow lower section are of circular cross-section having equal outer diameters.

16. An apparatus as claimed in claim 9 wherein the fluid displaceable members each comprises a seal.

17. A method for launching at least one plug, the method comprising launching at least one plug into a tubular into a wellbore using an apparatus for launching at least one plug into a tubular in a wellbore, said apparatus comprising a hollow upper section and a hollow lower section, said hollow upper section comprising first and second upper ports (12, 13) longitudinally spaced therein, said second upper port (13) being disposed above said first upper port (12) in operation, a landing seat (7) between said hollow upper section and said hollow lower section, and a first fluid displaceable member (4) initially retained in a first position below said second upper port (13), said hollow lower section being adapted to retain the at least one plug (8) and comprising at least a first lower port (10) thereabove and a landing collar (6) for receiving said first fluid displaceable member (4) in a second position, the arrangement being such that, in use, when the apparatus is installed at the top of a liner and lowered into the wellbore, launching of said at least one plug is effected by causing a first dart to land on said landing seat (7) so as to block said first upper port (12) and create a first fluid pressure differential across said first fluid displaceable member (4) by way of said second upper port (13), the fluid pressure differential serving to displace said first fluid displaceable member (4) to the second position on said landing collar (6), thus creating a fluid pressure differential across said at least one plug by way of said first lower port (10) to launch said at least one plug.

* * * * *